United States Patent [19]

Allen

[11] 4,068,552

[45] Jan. 17, 1978

[54] METHOD OF AND APPARATUS FOR PRODUCING MUSICAL INSTRUMENT KEYBOARD-CONTROLLED PITCH VARIATION, TONE ALTERATION AND THE LIKE

[76] Inventor: John Allen, 130 Hamilton St., Cambridge, Mass. 02138

[21] Appl. No.: 702,297

[22] Filed: July 2, 1976

[51] Int. Cl.[2] ..... G10H 1/02; G10H 3/02

[52] U.S. Cl. ..... 84/1.06; 84/1.14; 84/1.16; 84/1.24; 84/1.25; 84/433; 84/DIG. 7; 84/DIG. 24

[58] Field of Search ..... 84/1.04, 1.06–1.08, 84/1.14–1.16, 1.24, 1.25, 173, 174, 216, 423, 433, DIG. 7, DIG. 22, DIG. 24

[56] References Cited

U.S. PATENT DOCUMENTS

| | | | |
|---|---|---|---|
| 1,853,630 | 4/1932 | Martenot | 84/1.25 |
| 1,914,831 | 6/1933 | Martenot | 84/1.25 X |
| 2,871,745 | 2/1959 | Scott | 84/1.25 |
| 3,598,890 | 8/1971 | Suzuki | 84/1.24 X |
| 3,681,507 | 8/1972 | Slaats et al. | 84/1.24 X |
| 3,693,492 | 9/1972 | Ohno | 84/1.25 |
| 3,715,447 | 2/1973 | Ohno | 84/1.24 |
| 3,727,510 | 4/1973 | Cook, Sr. | 84/DIG. 22 |

*Primary Examiner*—Stanley J. Witkowski
*Attorney, Agent, or Firm*—Rines and Rines

[57] ABSTRACT

This disclosure is concerned with the production of pitch variations, tone alterations and other related effects on keyboard musical instruments and the like effected through mechanisms activated by individual longitudinal finger movement along the longitudinal axis of the keys.

9 Claims, 8 Drawing Figures

METHOD OF AND APPARATUS FOR PRODUCING MUSICAL INSTRUMENT KEYBOARD-CONTROLLED PITCH VARIATION, TONE ALTERATION AND THE LIKE

The present invention relates to methods of and apparatus for producing pitch variation, tone alteration and related effects in musical instruments and the like, being more particularly directed to a keyboard instrument wherein sound, produced by depression of an individual longitudinally extending key of the keyboard, may be modified by movement longitudinally backward and forward in the plane of the key, resulting in the sustained variation of pitch ("bent" notes, justly intoned intervals, glissando, sliding pitches, etc.,) and other varying characteristics.

The present state of the art in keyboard musical instruments ranges from those instruments in which a constant pitch is created by each individual key, to those instruments in which a vibrato effect may be created by a horizontal oscillation of blocks of keys, as disclosed, for example, in U.S. Pat. Nos. 1,853,630 and 1,914,831. Additionally, monophonic instruments have been proposed in which a glissando effect may be created between pitch steps, as described in U.S. Pat. No. 2,871,745, and instruments in which control of the pitch is effected after the initial tone is struck by means of a double touch control system, as described in U.S. Pat. No. 3,652,774, and in which application of an additional secondary amount of force upon the key after the original tone is struck allows another means of control of the tone; the stronger the additional secondary force, the more the variations of the pitch. Still other approaches have involved instruments in which downward depression of the key produces an expression control (i.e., volume control or, vibrato effect) by a lateral shaking of the keys, as illustrated in U.S. Pat. No. 3,715,447. Tension of the sound-creating string can also be varied by means of foot pedals, as in U.S. Pat. No. 3,763,735.

An object of the invention is to provide a novel stringed or similar musical instrument having a keyboard that allows individual control of each key to make possible variations in pitch, tone alteration and other related effects, such as "bent" notes, justly intoned intervals, sliding pitches, glissando, etc., in direct response to the backward and forward longitudinal motion of each longitudinally extending key.

Another distinct advantage of the backward and forward longitudinal motion of the key mechanism, directly related to the pitch variation, is that each individual key mechanism may slide the pitch intonation higher or lower responding to the backward or forward motion of the key.

In summary, from one of its broader aspects, the invention embraces a method of introducing tone variations to the sound created by donwardly depressed key mechanisms in musical instruments and the like, that comprises, mounting each longitudinally extending key mechanism with individual freedom of longitudinal motion in the direction backward and forward in the plane of the key; limiting the backward and forward movements within predetermined limits; and responding to said backward and forward movements of the downwardly depressed key mechanisms, to introduce corresponding pitch variations, tone alterations and related effects, separately and differently generated for each such individual key mechanism in accordance with the degree of backward and forward movement of the same. Preferred details and structures are later set forth.

Other and further objects will be explained hereinafter and are more particularly delineated in the appended claims.

The invention will now be described with reference to the accompanying drawings in which.

Figures 1, 2A, 2B, 2C:
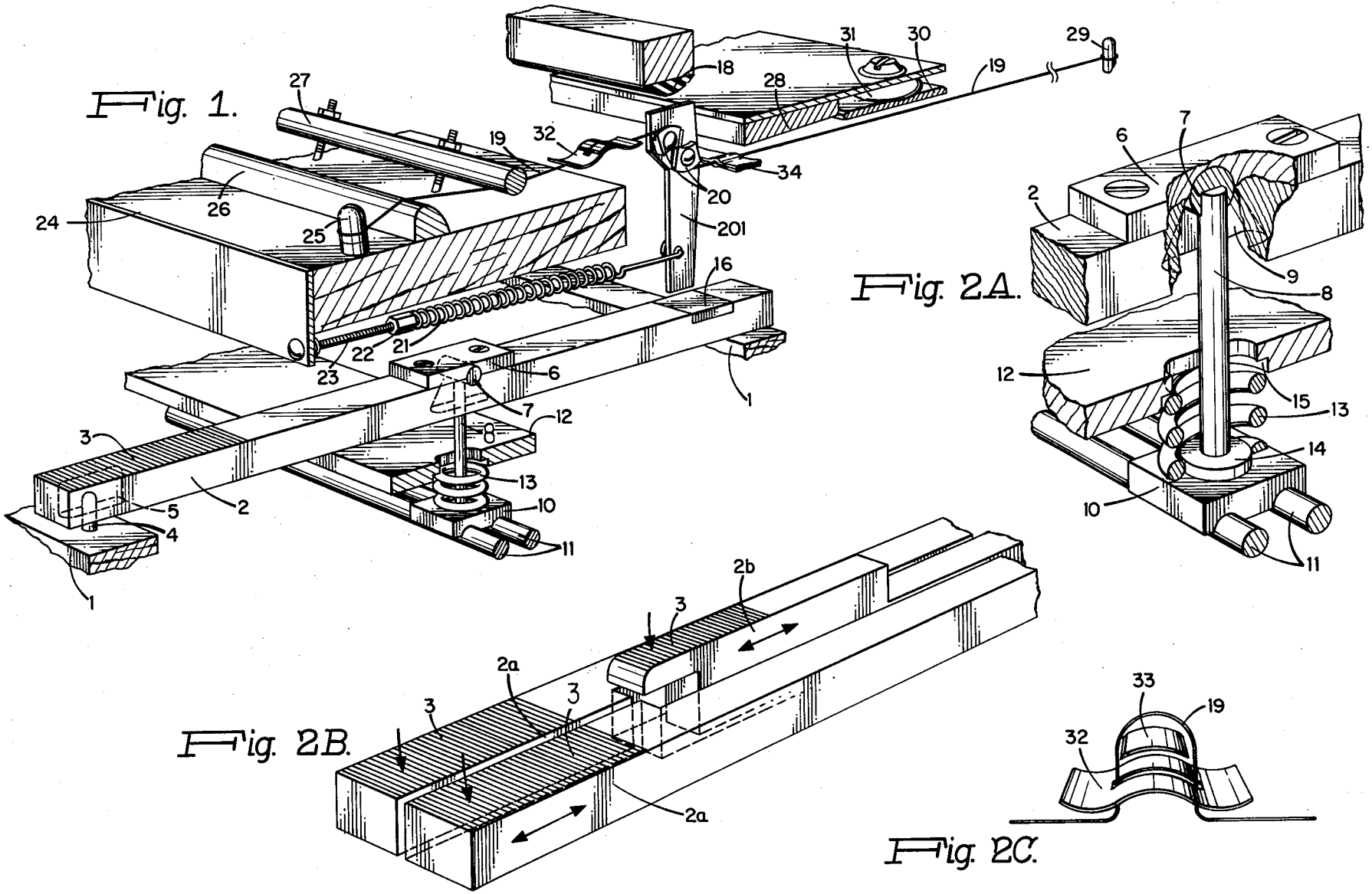
FIG. 1 is a perspective view, partly in section, of a key mechanism of a stringed musical instrument constructed in accordance with the invention.
FIG. 2A is a similar view of a portion of FIG. 1, upon an enlarged scale, illustrating the key-centering-and-positioning mechanism.
FIG. 2B is also a perspective view illustrating means for avoiding conflict between adjacent keys in backward and forward motion.
FIG. 2C is an exploded plan view of a string tensioning device.

In the embodiment of FIG. 1, the frame 1 of the key mechanism of a stringed musical instrument is shown supporting one of an intended plurality of planar longitudinally extending keys 2 that, upon manual downward depression produce sounds by striking strings 19, as is well known. The playing surface of the said keys 2 is preferably provided with lateral ridges 3, or surface undulations or other roughening or friction means such as fiber coverings or the like, for enabling non-slipping backward and forward longitudinal movement of the key, substantially in its plane, and while at the same time allowing untroublesome lateral motion of the player's fingers across the surfaces of the keys. The keys 2 may be arranged in two groups; the playing surfaces of the first group 2*a*, FIG. 2B, extending farther out to the outer edge of the instrument and being interiorly recessed or narrowed where passing under the playing surfaces of the keys of the other group 2*b*. The overhanging interior keys of the other group 2*b* allow motion relative to that of the keys of the first group 2*a* and in a plane parallel to the playing surfaces of both groups, but without keys of the two groups coming into contact, and without producing gaps in the playing transverse overall keyboard surface that would hinder the player.

Referring now particularly in FIGS. 1 and 2A, each key 2 is shown forwardly guided by a pin 4, which makes sliding contact with the inside of a slot 5, the long axis of which is parallel to the longitudinal axis of the key. A bearing 6 is affixed to the top of the key 2 at its intermediate pivot region and is provided on its lower side with a cylindrical bearing surface 7 apertured to receive the upper end of a vertical pin 8 that is accomodated in a longitudinal notch 9 in the key 2. The elongation of the slot 9 parallel to the longitudinal axis of the key 2 permits some rotation of the pin 8 about the axis of cylindrical bearing surface 7, and the pin 8 also prevents axial rotation and lateral translation of the key 2. At its lower end, the pin 8 is affixed to a bearing surface 10 resting on rails 11 extending transversely to the keys 2 and under the same. A plate 12 is disposed between the underside of the key 2 and the rails 11 and is longitudinally slotted to accomodate the lower part of the pin 8, with a spring 13 disposed between the plate 12 and the bearing surface 10. Disc 14 affixed to the bearing surface 10 and notch 15 in the underside of plate 12 maintain alignment of the spring 13. The lateral motion of the bearing surface 10 along the rails 11 is prevented by the adjacent bearing surfaces 10 of the adjacent key mechanisms (not shown) and by blocks at either end of the rails 11.

Upon the application of a force having a component in the longitudinal direction of the key 2, the pin 8 rotates either backward or forward, depending upon the resulting sliding motion of the key, backward or forward, rocking about either the rear or forward rail 11 and allowing the key 2 to move longitudinally under the pivot control of the forward pin 4 in its slot 5 and the pivot pin 8 in its slot 9. The key thus can be moved from its center, zero or rest position, longitudinally backward and forward substantially in its plane. The bearing surface 10 presents a controlled opposing force to such motion, and the predetermined limits to the backward and forward motion are determined by the pin 4 in its forward slot 5. An adjustment may be provided for the pin 4, allowing variations in the predetermined limits of motion.

A rubber or similar pad 16 is shown affixed to the upper rear portion of the key 2, FIG. 1. Upon depression of the key 2, the pad 16 establishes contact with a tensioner lever 201 which is driven upward until it contacts a horizontal rail 18 covered by acoustic and impact deadening material and affixed at its ends to the frame 1. The tone-producing string 19 is intermediately looped around two pulley segments 20 mounted near the top of the tensioner lever 201, being clamped between them in such a way that backward and forward motion of the lower end of said tensioner lever 201, as the key 2 is moved longitudinally backward or forward by the finger, decreases and increases the tension of the string 19. A rotational force on the tensioner lever 201, generated by the difference in points of origin on the tensioner lever of the force vectors produced by the tension on the segments of the string 19 ahead of and behind the lever, is counterbalanced by a tension spring 21 affixed to the lower end of the tensioner lever 201 with rotational freedom in a plane parallel to the longitudinal axis of said key 2. The tension spring 21 is affixed at its forward end to an adjustment collar 22 threaded on an adjustable bolt 23 attached to a wrest plank assembly 24, fixed to the frame 1 at its ends. At its forward end, the string 19 is fixed to a wrest pin 25 over a transverse nut bar 26 and under a bar 27 which is adjustable in height.

When the tensioner lever 201 is driven upward by the depressing of the key 2, the string 19 contacts a bridge 28 shortly before it comes to rest against the rail 18. The portion of the string 19 between the bridge 28 and the rear hitch pin 29, affixed to the frame 1, then is set into vibration by its sudden deceleration at the bridge 28.

When the key 2 is thus moved longitudinally backwards and forwards subsequent to depression, the tensioner lever 201 accordingly varies tension of the string 19, changing its musical pitch. Spring clip 32, as more particularly shown in FIG. 2C, is affixed to said string 19 by keeper 33, allowing the changing of length of the string 19 as required to effect a given tension change. When the key 2 is released, the tensioner lever 201 drops tension of the string 19, returning the same to its equalibrium value and damping oscillation by damping strip 34, FIG. 1.

Figure 5:
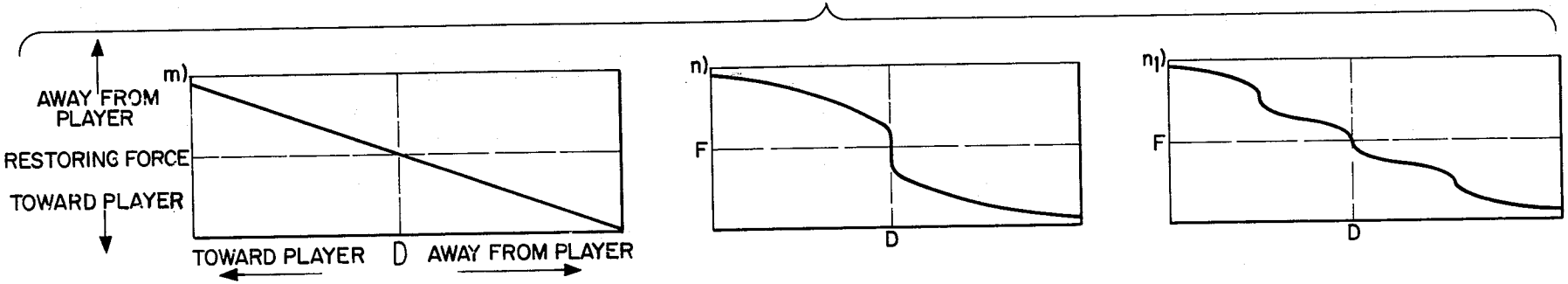

FIG. 5 illustrates by way of example several relationships between distance the key moves longitudinally and the restoring force that opposes such motion. In graph (*m*) a linear relationship between restoring force away from and toward the player is shown as a function of longitudinal displacement D. Other relationships may, of course, be introduced to produce desired tone "bending" information, sliding pitch, glissando and similar effects, by appropriate adjustment and shaping of the mechanism. As another example, graph (*n*) of FIG. 5 shows a nonlinear relationship in which the rate of increase of the restoring force is adjusted such that the rate of increase of the restoring force over a predetermined limited distance of motion is greatest immediately above and below the zero position, with the rate of increase of the magnitude of the force being more gradual on either side thereof. In the modified nonlinear relationship of graph ($n_1$) of FIG. 5, the rate of increase of the restoring force has three steep transitions, two on each side of the zero position, with gradual intermediate restoring force - displacement slopes.

Figure 6:
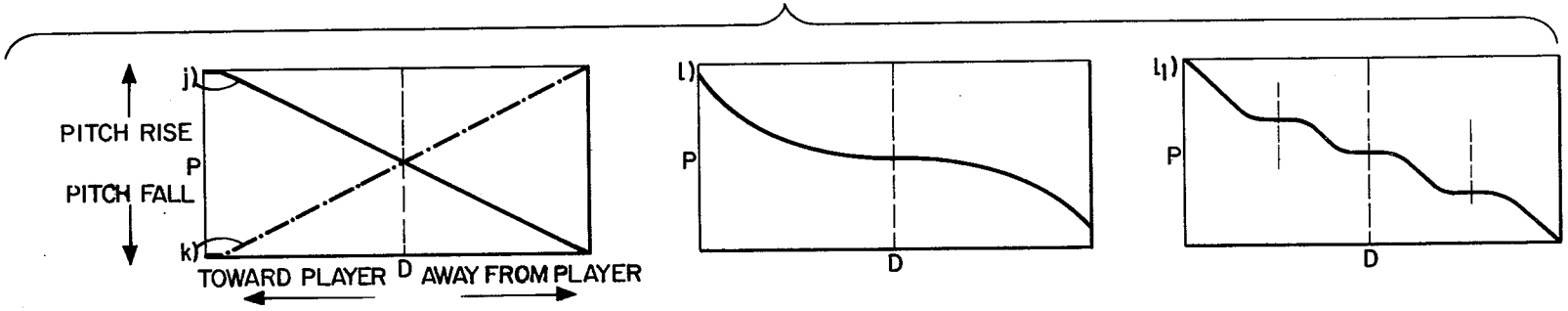
FIGS. 5 and 6 are graphs illustrating relationships between distance of key motion and pitch variation and relationships between distance of key motion and force applied to the key, according to the present invention.

FIG. 6 shows by way of similar example several relationships between distance D through which the key moves longitudinally, and the corresponding change in the musical pitch or other controlled variable. In graph (*j*), the pitch or similar controlled variable changes linearly with the longitudinal motion of the key; whereas in graph (*l*), the pitch changes non-linearly with its variation per unit of longitudinal motion D of the key being slightest immediately adjacent to the rest position of the key. In graph ($l_1$), on the other hand, similar regions of minimal change occur symmetrically on each side of the zero or rest position. Clearly, other variations will readily suggest themselves to those skilled in the art.

Figure 3:
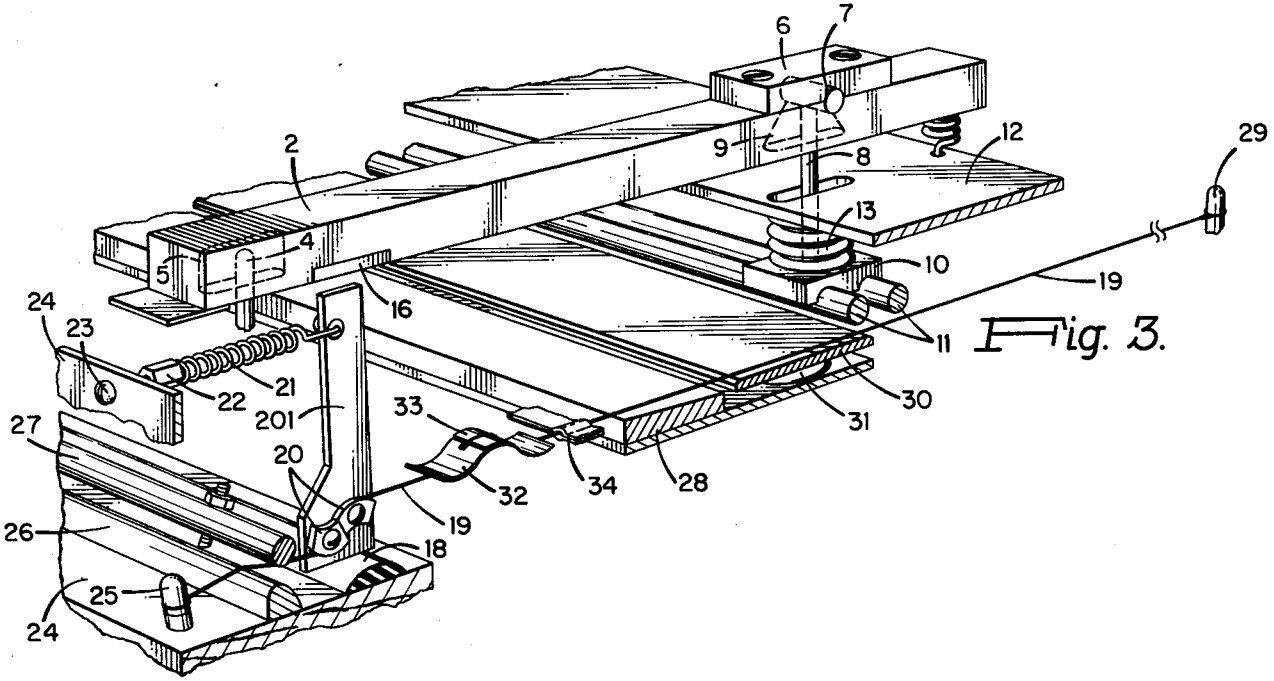
FIG. 3 is a view similar to FIG. 1 of a modified key mechanism of a stringed musical keyboard instrument embodying the invention.

While in the embodiment of FIG. 1 the strings, such as string 19, are shown mounted between pins 25 and 29 and associated elements 26, 27, etc. with the tensioner lever 201 and tensioning-changing mechanisms disposed above the keys 2, in the modification of FIG. 3, the keys 2 with their longitudinal sliding controls 4–5, 7–8, etc. are illustrated as disposed below the keys 2. In both embodiments, moreover, the strings may either be audibly monitored with an appropriate sounding board, and/or electronically reproduced as by a transducer 30 mounted by electrically insulated pads 31 to generate an electrical signal in response to the proximal vibrations of the respective strings 9.

Figure 4:
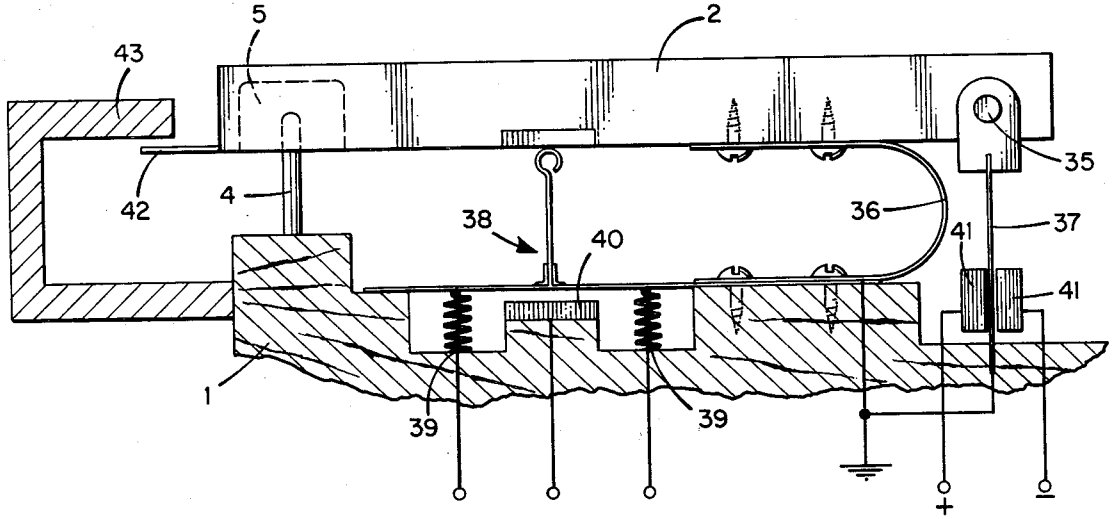
FIG. 4 is a side elevation, partly sectionalized, of an embodiment applied to an electronic key mechanism.

Still a further modified system particularly adapted for electronic tone production is shown in FIG. 4, where the keys 2 are shown at the top, provided with their forward longitudinal guiding pin and slot structure 4–5, but rearwardly pivotable at 35. Tone-generating oscillators and the like are not shown, the figure illustrating only the portions for sensing the depressing of the key to activate the tone generator and the sensing of the longitudinal movement for variation.

A C-shaped flat spring 36 is interposed between the frame 1 and the key 2, providing upward restoring force to the key while allowing the key to travel freely longitudinally in a backward and forward direction, with further springs 37 and 38, interposed between the pivot joint 35 and the frame 1, and between the underside of the key 2 and a lower plate extending from the lower arm of the spring 36, respectively.

When the key 2 is depressed, spring 38 establishes contact with resilient keying contacts 39 and with a pressure-sensitive resistive block 40, as of carbon or piezoelectric or similar material. As the key is moved backwards and forwards longitudinally, subsequent to being depressed, the springs 36, 37 and 38 accomodate this motion, and pick-up pressure-sensitive resistive elements 41, disposed on each side of grounded spring 37, differentially monitor the rocking motion of the spring 37. When the key 2 is released its upward motion is limited by a clip 42 engaging a frame projection 43 forward of the front end of the key. Clearly, other types of sensing elements may also be used, as is well known.

Further modifications will also occur to those skilled in the art, and such are considered to fall within the spirit and scope of the invention as defined in the appended claims.

What is claimed is:

1. A method of introducing tone variations into the sound created by the impact of downwardly depressed longitudinally extending planar playing key mechanisms in musical instruments, that comprises, depressing the key mechanisms individually; moving each key mechanism with individual freedom of longitudinal movement backward and forward substantially in the plane of the keys; limiting such backward and forward movement within predetermined limits; and responding to said backward and forward movement of the downwardly depressed key mechanisms to introduce corresponding pitch variations, tone alternations and related effects, said pitch variations being separately and differently generated for the individual key mechanisms in accordance with the degree of backward and forward movement of the corresponding key mechanisms.

2. A musical instrument having planar longitudinally extending keys for manual depression to produce sounds, key centering and positioning means connected with each key adapted to enable downward depression and independent movement of the same longitudinally backward and forward substantially in the plane of the keys, said means being provided with limiting means for restricting such backward and forward movement within predetermined limits, and means connected with and responsive to the movement of said positioning means for introducing controlled pitch variation, tone alterations and related effects in response to said backward and forward movement of the individual key, independently altering the sound developed by depression of each key.

3. A musical instrument as claimed in claim 2 in which said instrument is stringed, said means to enable downward depression effects sounding of a string, and said pitch variation introducing means comprises means for varying string tension.

4. A musical instrument as claimed in claim 2 and in which said instrument is electronic, said means to enable downward depression effects electronic note production, and said pitch variation introducing means comprises transducer means coupled to said key mechanisms and responsive to variation in longitudinal position thereof.

5. A musical instrument as claimed in claim 2, wherein said centering and positioning means is provided with an element generating a restoring force upon each individual key to return said key to predetermined limits of motion and positions intermediate the same.

6. A musical instrument as claimed in claim 5 wherein said element is provided with a nonlinear restoring force.

7. A musical instrument as claimed in claim 6 wherein said restoring force is adjusted such that the rate of increase of the restoring force is greatest immediate the position at which said force is zero.

8. A musical instrument as claimed in claim 2 wherein the keys are provided with means for limiting troublesome sideways motion of the same.

9. A musical instrument as claimed in claim 2 wherein said keys are of two groups, the playing surfaces of one group extending beyond those of the other group with the playing surfaces of said other group overhanging the playing surfaces of one group, each key of both groups being independently movable longitudinally in its plane.

* * * * *